US009661979B2

(12) United States Patent
Herrmann

(10) Patent No.: US 9,661,979 B2
(45) Date of Patent: May 30, 2017

(54) METHOD FOR OPERATING A WATER-BEARING DOMESTIC APPLIANCE

(75) Inventor: Mathias Herrmann, Nattheim (DE)

(73) Assignee: BSH Hausgeräte GmbH, Munich (DE)

( * ) Notice: Subject to any disclaimer, the term of this patent is extended or adjusted under 35 U.S.C. 154(b) by 1344 days.

(21) Appl. No.: 12/739,962

(22) PCT Filed: Oct. 24, 2008

(86) PCT No.: PCT/EP2008/064447

§ 371 (c)(1),
(2), (4) Date: Apr. 27, 2010

(87) PCT Pub. No.: WO2009/056495

PCT Pub. Date: May 7, 2009

(65) Prior Publication Data

US 2010/0229893 A1 Sep. 16, 2010

(30) Foreign Application Priority Data

Oct. 31, 2007 (DE) ..... 10 2007 052 085

(51) Int. Cl.

| | |
|---|---|
| ***B08B 7/04*** | (2006.01) |
| ***B08B 3/00*** | (2006.01) |
| ***A47L 15/42*** | (2006.01) |
| ***D06F 33/02*** | (2006.01) |
| ***D06F 39/00*** | (2006.01) |

(52) U.S. Cl.

CPC ..... *A47L 15/4229* (2013.01); *D06F 33/02* (2013.01); *D06F 39/007* (2013.01); *A47L 2401/06* (2013.01); *A47L 2501/07* (2013.01); *A47L 2501/34* (2013.01); *D06F 2202/08* (2013.01)

(58) Field of Classification Search

CPC ..... A47L 15/0018; A47L 15/0023; A47L 15/0047; A47L 15/0049; A47L 15/4229; A47L 2501/07; A47L 2401/06; A47L 2501/34; D06F 35/00; D06F 33/02; D06F 39/007; D06F 2202/08

USPC ..... 134/18, 25.2, 56 D, 57 D, 58 D; 8/158; 68/13 R

See application file for complete search history.

(56) References Cited

U.S. PATENT DOCUMENTS

| | | | | |
|---|---|---|---|---|
| 4,119,116 | A * | 10/1978 | Johnson et al. | 137/387 |
| 4,641,671 | A * | 2/1987 | Nogi et al. | 134/57 D |
| 5,269,922 | A * | 12/1993 | Lin | 210/282 |
| 5,409,023 | A * | 4/1995 | Santarossa et al. | 134/57 D |
| 5,853,599 | A * | 12/1998 | Hsu | 210/739 |
| 5,871,639 | A * | 2/1999 | Hsu | 210/87 |
| 6,120,691 | A * | 9/2000 | Mancil | 210/748.11 |
| 6,685,825 | B1 * | 2/2004 | Chang | 210/87 |
| 6,887,318 | B2 * | 5/2005 | Bashark | 134/18 |
| 7,346,434 | B2 * | 3/2008 | Goza | 700/282 |
| 2005/0178406 | A1 * | 8/2005 | Kang | 134/18 |
| 2006/0060512 | A1 * | 3/2006 | Astle et al. | 210/85 |
| 2007/0093936 | A1 * | 4/2007 | Johnson et al. | 700/240 |
| 2010/0000023 | A1 * | 1/2010 | McAllister et al. | 8/137 |

FOREIGN PATENT DOCUMENTS

| | | | |
|---|---|---|---|
| DE | 19749636 | A1 * | 5/1999 |
| DE | 10163192 | A1 | 7/2003 |
| DE | 10204455 | A1 | 8/2003 |
| DE | 102004021200 | A1 | 11/2005 |
| DE | 102004057390 | A1 | 3/2006 |
| DE | 102006027477 | A1 | 12/2006 |
| EP | 741990 | A2 * | 11/1996 |
| EP | 1593335 | A2 | 11/2005 |
| EP | 1844693 | A1 | 10/2007 |
| GB | 2258306 | A * | 2/1993 |

* cited by examiner

*Primary Examiner* — Alexander Markoff
(74) *Attorney, Agent, or Firm* — Michael E. Tschupp; Andre Pallapies

(57) ABSTRACT

A water-bearing domestic appliance and method of operating a water-bearing domestic appliance, wherein the domestic appliance includes a water feed system that is controlled by a control device and that supplies a measured volume of water to the domestic appliance. The domestic appliance further includes a total water volume detection device to detect a total volume of water that is supplied via the water feed system to the domestic appliance during its service life.

18 Claims, No Drawings

METHOD FOR OPERATING A WATER-BEARING DOMESTIC APPLIANCE

BACKGROUND OF THE INVENTION

The invention relates to a method for operating a water-bearing domestic appliance.

Modern water-bearing or water-conducting household appliances, such as e.g. dishwashers or washing machines, are provided with a water feed system by means of which a volume of water required for a specific program step can be supplied to the household appliance on the basis of an automatically executing program controller. Thus, in dishwashers, for example, various wash programs are used which typically include the program steps "pre-wash", "clean", "intermediate wash", "rinse" and "dry". In order to wash the items requiring to be washed a certain amount of washing solution ("wash liquor") is required according to the particular program step, this amount being set via the water supply system.

Regular maintenance operations are necessary in water-bearing domestic appliances in order to ensure problem-free operation over a prolonged period of time. For example, the water supplied in modern dishwashers is softened by means of a special water softening device (ion exchanger) in order to avoid chalky deposits ("limescale") in the water-conducting components and limescale residues on the items being washed. When water is routed through the ion exchanger, the Ca2+ ions responsible for the water hardness are replaced by Na+ ions, for example, as a result of which the water becomes softer. When the ion exchanger becomes fully loaded with Ca2+ ions, it is necessary to perform a regeneration, this being effected by using a regeneration salt by means of which the Ca2+ ions contained in the ion exchanger are replaced by Na+ ions, for example.

In the prior art such an automatically executing regeneration of the ion exchanger initiated by means of the program controller is performed following completion of a specific number of wash cycles preset ex works, the number varying as a function of a local water hardness requiring to be set manually by the user.

The factory presets known from the prior art do not take into account a characteristic deterioration in the exchanger performance of the ion exchanger with advancing lifetime of the appliance, with the result that a degradation of exchanger performance can occur already in the case of older appliances before the next regeneration of the ion exchanger is due.

In similar fashion a number of further maintenance operations are necessary in water-bearing domestic appliances, such as checking the circulation pump serving to circulate the wash liquor, for example, and cleaning or replacing a water filter in the feed system, which activities in the prior art are usually carried out after a period in the appliance lifetime has elapsed which is based on empirical values, without taking into account in this case an actual degree of wear to which the individual domestic appliance has been subjected, with the possible consequence that the corresponding maintenance activities may not be carried out until it is too late, at a time when losses in functional efficiency have already occurred.

BRIEF SUMMARY OF THE INVENTION

Accordingly there is need for a water-bearing domestic appliance as well as for a method for operating the same, wherein it is made possible to perform maintenance activities as a function of an actual degree of wear of the domestic appliance that is dependent on the individual user.

This object is achieved according to the proposal of the invention by means of a method for operating a water-bearing domestic appliance as well as by means of a water-bearing domestic appliance. Advantageous embodiments of the invention are disclosed by the features of the dependent claims.

According to the invention, a water-bearing domestic appliance having a water feed system controlled by a control device, in particular an electronic control device, for supplying a measured volume of water to the domestic appliance is disclosed, along with a method for operating the domestic appliance. The electronic control device is used for performing at least one program for operating the domestic appliance. A (selectable) specific volume of water can be supplied to the domestic appliance via the water feed system controlled by the control device as a function of the executing program or program step.

The domestic appliance is essentially characterized in that it is equipped with a total water volume recording device for recording a total volume of water supplied via the water feed system to the domestic appliance during its lifetime. According to the invention, a total water volume supplied to the domestic appliance via the water feed system during the appliance's lifetime is recorded by means of the total water volume recording device.

By recording the total water volume supplied to the water-bearing domestic appliance over the appliance's lifetime it is possible to discover the actual, specific and individual level of wear to which the domestic appliance is subjected in the case of a particular user. Thus, it is advantageously made possible for appliance functions to be performed in accordance with an actual level of wear of the water-bearing domestic appliance.

The invention will now be explained in more detail with reference to several exemplary embodiments which merely serve the purpose of illustrating the invention, without the invention being limited hereto.

EXAMPLE 1

A domestic dishwasher is provided with a water feed system controlled by an electronic control device for the purpose of controlling various wash programs, the water feed system being connected to an external water supply (domestic water connection). Measured individual volumes of water can be supplied to the dishwasher in a desired manner via the water feed system according to the wash program or program step currently being performed by the control device.

For this purpose the water feed system is provided with an electromagnetic feed valve which is controlled by the control device and by means of which the water supply to the domestic appliance can be shut off or opened. Thus, the feed valve is closed by means of a corresponding control signal from the control device when the control device detects that a volume of water desired for a wash program or a program step has been supplied via the water feed system. In an analogous manner the water feed can be released by way of an opening of the feed valve.

For this purpose the water feed system also comprises an (individual) total water volume recording device which is connected to the control device for data communication purposes and by means of which a volume of water being supplied to the dishwasher in a wash program or program step being executed at the time can be recorded. A total water volume recording device of this kind can be embodied in a multiplicity of ways. For example, the volume of water supplied is recorded via a flow meter which is disposed in the water feed system and in which the volume of water being supplied is measured by an impeller rotated by the inflowing stream of water. When a specific (selectable) supplied volume of water has been registered via the flow meter, the control device shuts off a further supply of water via the feed valve.

Alternatively the water volume recording device can also comprise for example a feed tank provided with a float, the feed valve in this case being closed by the control device when the float reaches a specific (selectable) level.

Equally conceivable is a filling of a feed tank made possible only for a specific (selectable) period of time by the control device via the feed valve.

An electronic total water volume recording device is integrated into the electronic control device for controlling the programs and program step sequencing of the dishwasher in order to record the total volume of water supplied to the dishwasher during the appliance's lifetime. The electronic total water volume recording device aggregates the volume of water supplied by the (individual) water volume recording device for a wash program or program step performed at a given time over the appliance lifetime and stores said (aggregated) total water volume in a nonvolatile data memory device of the control device.

In order to avoid limescale deposits, the dishwasher is also equipped with a water softening device (ion exchanger) by means of which the Ca2+ ions contained in the water being supplied can be replaced by Na+ ions, for example. A regeneration of the ion exchanger is performed under the control of the control device through use of a regeneration salt, the Ca2+ ions contained in the water being replaced by Na+ ions, for example. A regeneration is performed under the control of the control device as a function of a water hardness that can be set by the user, in each case after a selectable total volume of water has been supplied, thereby enabling a regeneration to take place at definable graduations in the total water volume supplied and taking into account the actual level of wear of the dishwasher. A degradation in exchanger performance can be taken into account in particular on the basis of a performance map (automatic performance control) or, as the case may be, a preprogrammed table.

EXAMPLE 2

As described in example 1, a domestic dishwasher is provided with an electronic control device having an electronic total water volume recording device and a water feed system controlled by the control device and having an (individual) water volume recording device. In order to avoid unnecessary repetitions, only the differences from the domestic dishwasher of example 1 are explained here and in other respects reference is made to the explanations given in relation to example 1.

The dishwasher is provided with a cleaning device controlled by the control device and serving to dispense detergent for cleaning the dishwasher. For this purpose a detergent that is present in compacted form as, for example, a detergent tablet ("lozenge shape") is introduced into the cleaning device. By selective dissolution of detergent from the detergent tablet by means of wash liquor a desired amount of detergent for cleaning the dishwasher can be dispensed under the control of the control device. In this case a choice of the dispensed amount of detergent is made on the basis of the total volume of water supplied, such that the amount of supplied detergent can be chosen in defined graduations of the supplied total volume of water. In this case the dishwasher can be cleaned in particular on the basis of a performance map or, as the case may be, a preprogrammed table.

EXAMPLE 3

As described in example 1, a domestic dishwasher is provided with an electronic control device having an electronic total water volume recording device and a water feed system controlled by the control device and having an (individual) water volume recording device. In order to avoid unnecessary repetitions, only the differences from the domestic dishwasher of example 1 are explained here and in other respects reference is made to the explanations given in relation to example 1.

The value of the supplied total water volume is stored in a nonvolatile data memory device of the control device of the dishwasher and made available for external access so that it can be read out, by a service engineer for example. If faults or damage occur during the operation of the dishwasher it is important to know for fault analysis purposes how the dishwasher has actually been used by the user. The total volume of water supplied to the dishwasher or, as the case may be, the actual level of wear of the dishwasher resulting therefrom can be a useful aid to the service engineer during troubleshooting. Furthermore the information about the total volume of water supplied up to the occurrence of a fault or damage can also serve for improving potential problem points of the appliance and accordingly be used with regard to a technical improvement and further development.

The invention claimed is:

1. A method for operating a water-bearing domestic appliance, comprising:

a. controlling a water feed system by an electronic control device;

b. supplying, via the water feed system, specific volumes of water to a treatment chamber of the water-bearing domestic appliance for each wash program or program step to be performed;

c. recording the specific volumes of water being supplied to the treatment chamber of the water-bearing domestic appliance for each wash program or program step being performed using an individual water volume recording device, wherein the individual water volume recording device is in communication with the electronic control device;

d. performing one or more wash programs or program steps controlled by the electronic control device; and e. aggregating a total water volume using an electronic total water recording device integrated with the electronic control device, wherein the total water volume is an aggregate of the specific volumes of water recorded by the individual water volume recording device including all water supplied to the treatment chamber of the water-bearing domestic appliance, via the water feed system, from each wash program or program step performed during a lifetime of the water-bearing domestic appliance.

2. The method of claim 1, wherein the water-bearing domestic appliance is one of a dishwasher and a washing machine.

3. The method of claim 1, wherein a value representing a total water volume recorded by the total water volume recording device is transmitted to the electronic control device.

4. The method of claim 2, wherein the electronic control device controls an appliance function in accordance with a recorded total water volume.

5. The method of claim 4, wherein the electronic control device controls regeneration of a water softening device for softening supplied water as a function of the recorded total water volume.

6. The method of claim 4, wherein the electronic control device controls dispensing of detergent for cleaning the domestic appliance as a function of the recorded total water volume.

7. The method of claim 3, wherein the value representing the total water volume recorded by the total water volume recording device is stored in a nonvolatile data memory device of the electronic control device.

8. The method of claim 7, wherein the value representing the total water volume recorded by the total water volume recording device is stored in the nonvolatile data memory device and is externally accessible via the electronic control device.

9. A water-bearing domestic appliance, comprising:

a. an electronic control device;

b. an individual water volume recording device in communication with the electronic control device to record specific volumes of water being supplied to the treatment chamber of the water-bearing domestic appliance for each wash program or program step being performed;

c. a water feed system controlled by the electronic control device to supply the specific volumes of water to the treatment chamber of the water-bearing domestic appliance for each wash program or program step being performed;

d. a wash program controlled by the electronic control device, the wash program programmed to conduct one or more program steps; and e. an electronic total water volume recording device, integrated with the electronic control device, wherein the total water volume recording device aggregates a total of the specific volumes of water recorded by the individual water volume recording device including all water supplied via the water feed system to the treatment chamber of the water-bearing domestic appliance from each wash program or program step performed during a lifetime of the water-bearing domestic appliance.

10. The water-bearing domestic appliance of claim 9, wherein the electronic control device includes a nonvolatile data memory device to store a value for the detected total water volume.

11. The water-bearing domestic appliance of claim 10, wherein the control device is configured to control an appliance function in accordance with the recorded total water volume.

12. The water-bearing domestic appliance of claim 11, further comprising a water softening device, wherein the electronic control device is configured to control regeneration of the water softening device as a function of the recorded total water volume.

13. The water-bearing domestic appliance of claim 11, wherein the electronic control device is configured to control dispensing of a detergent for cleaning the water-bearing domestic appliance as a function of the recorded total water volume.

14. The water-bearing domestic appliance of claim 9, wherein the water feed system further includes a feed valve controlled by the electronic control device for opening or closing a water supply to the water-bearing domestic appliance.

15. The water-bearing domestic appliance of claim 14, wherein the feed valve comprises an electromagnetic feed valve, wherein the feed valve is closed and opened by a corresponding control signal received from the electronic control device.

16. The water-bearing domestic appliance of claim 9, wherein the individual water volume recording device comprises a flow meter disposed in the water feed system.

17. The water-bearing domestic appliance of claim 9, wherein the individual water volume recording device comprises a feed tank provided with a float, wherein a feed valve is closed by the electronic control device when the float reaches a specified level.

18. The water-bearing domestic appliance of claim 9, wherein the individual water volume recording device comprises a feed tank, wherein the electronic control device, via a feed valve, fills the feed tank for a specified period of time.

* * * * *